United States Patent [19]

Bergander et al.

[11] 4,054,886

[45] Oct. 18, 1977

[54] TRANSMITTING/RECEIVING ANTENNA HAVING MIRROR SYMMETRY AND DEFINED POLARIZATIONS

[75] Inventors: Armin Bergander, Ay (Iller); Georg Kurz, Ulm (Danube), both of Germany

[73] Assignee: Licentia Patent-Verwaltungs-G.m.b.H., Frankfurt am Main, Germany

[21] Appl. No.: 639,604

[22] Filed: Dec. 10, 1975

Related U.S. Application Data

[63] Continuation-in-part of Ser. No. 633,023, Nov. 17, 1975.

[30] Foreign Application Priority Data

Nov. 16, 1974 Germany ..... 2454401
Dec. 11, 1974 Germany ..... 2458584

[51] Int. Cl.[2] ..... H01Q 11/10; H01Q 3/26

[52] U.S. Cl. ..... 343/792.5; 343/113 R; 343/816; 343/854

[58] Field of Search ..... 343/792.5, 816, 853, 343/854, 113 R, 756, 792.5

[56] References Cited

U.S. PATENT DOCUMENTS

| | | | |
|---|---|---|---|
| 3,249,946 | 5/1966 | Flanagan | 343/792.5 |
| 3,470,559 | 9/1969 | Radford | 343/792.5 |

*Primary Examiner*—Eli Lieberman
*Attorney, Agent, or Firm*—Spencer & Kaye

[57] ABSTRACT

An antenna arrangement composed of at least two individual antennas of the same type and each having a pair of signal applying terminals, and a processing circuit connected to the terminals of the antennas for establishing a selected relation between the voltages across the terminals or between voltages derived from these voltages, wherein, for giving the arrangement a desired radiation polarization characteristic, the individual antennas and the circuit are arranged for causing the total radiation pattern of the arrangement to have mirror symmetry with respect to a selected plane.

19 Claims, 8 Drawing Figures

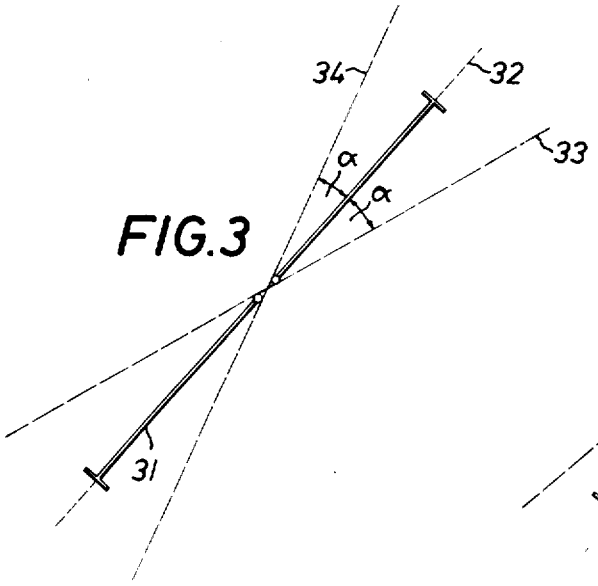
FIG.3
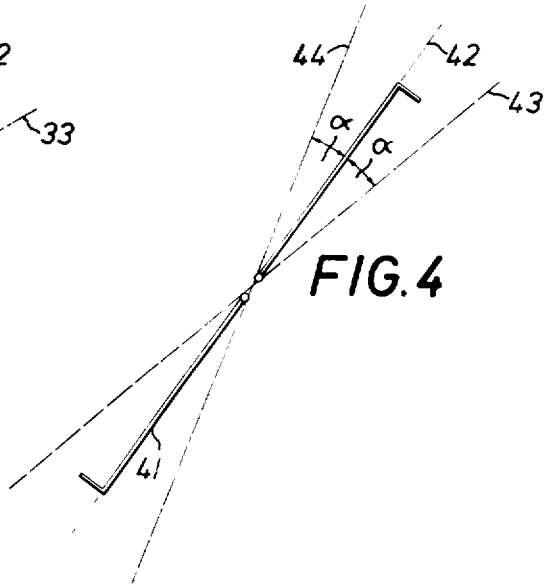
FIG.4
FIG.5
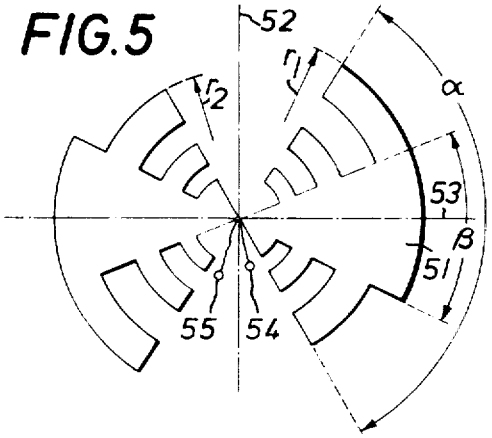
FIG.6
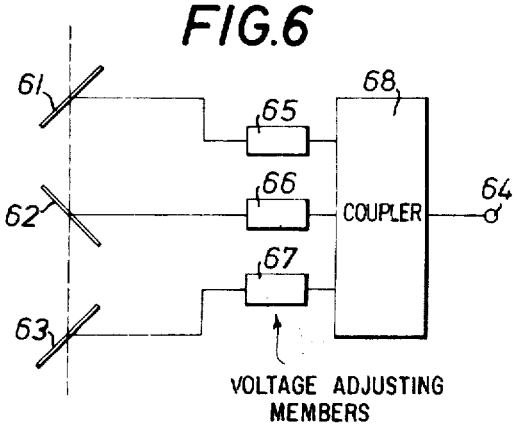
FIG.7
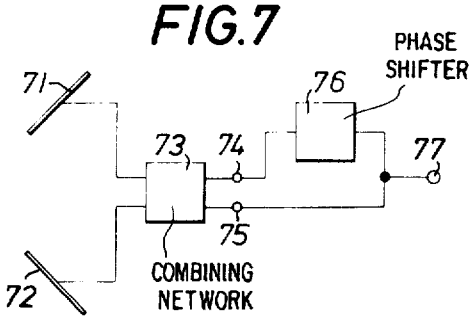

TRANSMITTING/RECEIVING ANTENNA HAVING MIRROR SYMMETRY AND DEFINED POLARIZATIONS

CROSS-REFERENCE TO RELATED APPLICATION

The present application is a continuation-in-part of copending application Ser. No. 633,023, filed on Nov. 17th, 1975 and entitled BROADBAND ANTENNA HAVING SMALL DIMENSIONS.

BACKGROUND OF THE INVENTION

The present invention relates to a transmitting and/or receiving antenna composed of two or more individual antennas of any desired polarization, which may even be a frequency dependent polarization.

The term "antenna" as used herein is intended to encompass antennas having reflectors as well as antennas not having reflectors.

As is known, a high gain antenna array requires a large number of individual antennas. In order to obtain the desired radiation pattern characteristics, the individual antennas are combined into directional beam networks, the summing members preferably being hybrids, i.e. components having decoupling properties which generally serve to combine or divide voltages at the same frequency with respect to amplitude or phase, if required, with a weighting of the individual voltages.

Antenna arrays having defined polarization properties require a certain alignment of their individual antennas. Antenna arrays intended to have a vertical polarization are usually constructed of vertically polarized individual antennas and antenna arrays which are to exhibit horizontal polarization are designed with horizontally polarized individual antennas. If both polarizations are to be available simultaneously, this is usually realized by employing individual antennas in a crosswise arrangement with the same phase center.

The known antenna arrangements composed of individual antennas with undefined polarization have the drawback that in addition to the desired polarization, there occurs an undesirable transverse polarization, so that when such antenna arrangements are used, for example, for direction finding purposes, it is easily possible that bearing errors might occur.

SUMMARY OF THE INVENTION

It is therefore an object of the present invention to provide a transmitting and/or receiving antenna array having a defined polarization and composed of individual antennas having any desired polarization, and not exhibiting undesirable transverse polarization.

This and other objects are accomplished according to the invention, and the defined antenna polarizations are produced, by providing for each individual antenna, an individual antenna of the same type which is arranged, with respect to a selected plane, in mirror symmetry to the first antenna, this second antenna preferably being a mirror image of the first antenna, or, if the arrangement of individual antennas is not in mirror symmetry, such mirror symmetry is produced by suitably adjusting the relations between the voltages of the individual antennas.

Advantageously one or a plurality of pairs of mirror-image individual antennas are arranged in mirror symmetry with respect to a plane and have a symmetrical or asymmetrical radiation pattern.

It is advantageous to provide one or a plurality of pairs of identical individual antennas, with the antennas of each pair being arranged in mirror symmetry to one another with respect to a plane, whereby the individual antennas each have preferably a symmetrical radiation pattern.

In a non-mirror-symmetrical arrangement of individual antennas, the mirror symmetry is advisably produced by different weightings of the input or output voltages of the individual antennas.

A combination of the three last-mentioned antenna designs is also advantageous.

According to an advantageous embodiment of the invention, individual antennas are used which are mirror symmetrical with respect to at least one reflection plane whose orientation can be selected at will.

According to a further embodiment, all individual antennas are of the same type.

In one embodiment, use is made of broadbanded individual antennas, preferably logarithimic-periodic antennas, particularly those having at least one reflector. The individual antennas of each pair are inclined to the reflection plane preferably at an angle of 45° so that they are perpendicular to one another.

Advantageously the individual antennas are of the type which permit generation of the same defined antenna polarization below the lower limit frequency of their operating frequency range as is possible in their actual operating frequency.

Decoupled energy dividers, or hydbrids, are employed to form sums and/or differences of the output voltages of the individual antennas.

In order to combine the output voltages by means of active and/or passive members, means are provided to weight the voltages with respect to amplitude and/or phase, and if required also with respect to frequency.

In one embodiment of the invention, the output voltages of the individual antennas can be combined in special members for any desired polarization.

According to a further embodiment, members are provided to produce left-hand or right-hand elliptical, and particularly circular, polarization.

According to a significant embodiment, the antenna system is intended for transmitting operation, while according to another embodiment the antenna system is intended as a receiving or ranging antenna arrangement.

According to a further embodiment, the antenna arrangement is designed for alternating operation as a transmitting, receiving and/or direction finding or ranging antenna arrangement.

In the case of an antenna arrangement which performs a transmitting function, the individual antennas may be connected to suitable signal splitters analogous to the signal processing circuits described above with respect to receiving antenna systems.

BREIF DESCRIPTION OF THE DRAWING

FIG. 3 shows a capcitively loaded symmetrical dipole antenna consisting of wires which lie in the plane of the drawing.

FIG. 4 shows a capacitively loaded a symmetrical dipole antenna consisting of wires which lie in the plane of the drawing.

FIG. 5 shows a two section logarithmic periodic planar antenna which has an asymmetrical radiation pattern with respect to the axis 53.

FIG. 6 shows an embodiment of an antenna system according to the invention, which consists of three antennas of the type shown in FIG. 5, only the axes of these antennas being shown, and a combining network.

FIG. 7 shows an embodiment of an antenna system according to the invention, which consists of two antennas of the type shown in FIG. 5, only the axes of these antennas being shown, and a combining network.

DESCRIPTION OF THE PREFERRED EMBODIMENTS

Figure 1:
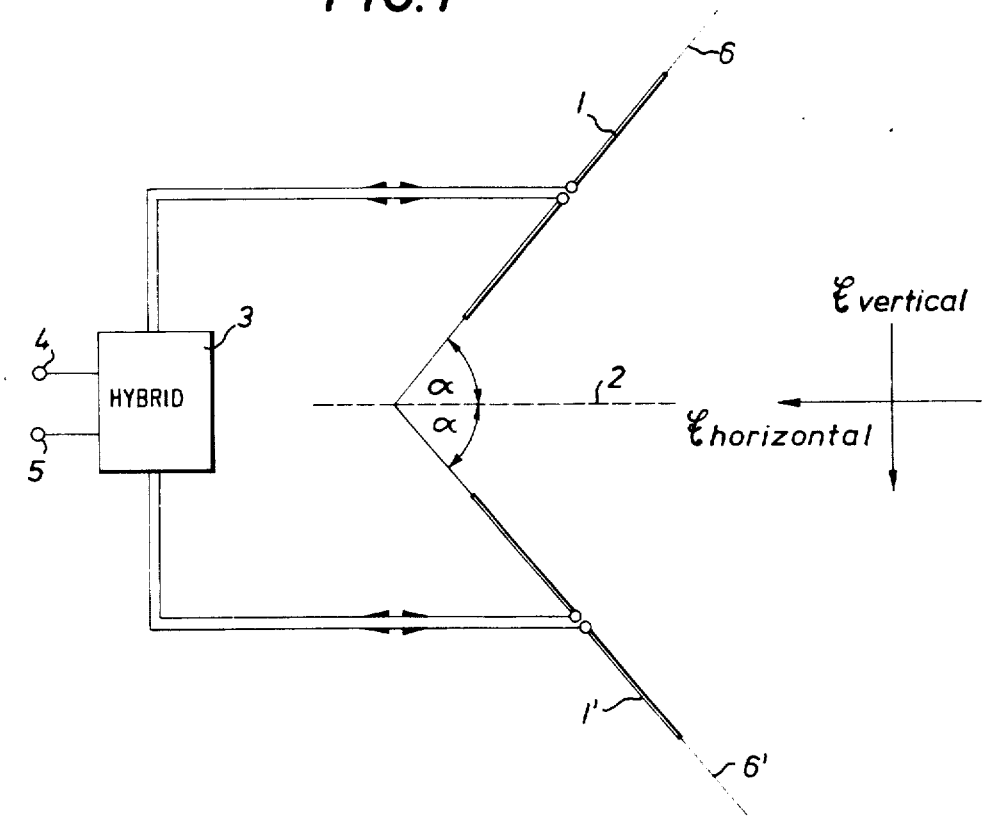
FIG. 1 is a simplified pictorial view of one embodiment of an antenna system according to the invention.

The antenna system according to the invention shown in FIG. 1 consists of two individual antennas 1 and 1' which are each arranged at an angle of inclination $\alpha$, of preferably 45°, with respect to a plane of reflection 2 perpendicular to the plane of the drawing, in mirror symmetry to one another. By additive or subtractive combination of the output voltages of the two individual antennas in a hybrid 3, there is obtained, as will be described in detail below, at a terminal 4 or 5 of the hybrid, a voltage which is proportional to the vertical or horizontal component of the electrical field strength of an electromagnetic wave which impinges in a direction perpendicular to the plane of the drawing.

To explain this, it is assumed that the field components $\epsilon_{vertical}$ and $\epsilon_{horizontal}$ are oriented as shown in FIG. 1. The complex output voltages $\overline{U_1}$ and $\overline{U_{1'}}$ of the individual antennas 1 and 1', respectively, can then be represented $$\overline{U_1} = \overline{U}_{vertical} + \overline{U}_{horizontal}$$

and $$\overline{U_{1'}} = \overline{U}_{vertical} - \overline{U}_{horizontal}$$

where $\overline{U}_{vertical}$ and $\overline{U}_{horizontal}$ are voltages produced in the two individual antennas by the vertical and horizontal components, respectively, of the electrical field, and are thus proportional thereto. For the orinetation of the electrical field shown in FIG. 1, these voltages can be assumed to be identical in both individual antennas. Obviously, it then applies that $$\overline{U}_{vertical} \sim \overline{U_1} + \overline{U_{1'}}$$

and $$\overline{U}_{horizontal} \sim \overline{U_1} - \overline{U_{1'}}$$

i.e. by forming the sum or difference of the output voltages of the individual antennas, a voltage is obtained which is proportional to the vertical or horizontal component, respectively, of the electric field strength.

For transmission, if both individual antennas are fed with the same amplitude and phase, (i.e. $\overline{U_1} = \overline{U_{1'}}$) the antenna according to FIG. 1 radiates, in a direction perpendicular to the plane of the drawing, an electromagnetic wave which is vertically polarized, while if the antennas are fed in phase opposition (i.e. $\overline{U_1} = -\overline{U_{1'}}$), a horizontally polarized electromagnetic wave is radiated.

Proper separation of the vertical and horizontal polarizations in the antenna system shown in FIG. 1 is, in the simplest case achieved by the use of two identical individual antennas 1 and 1' each having a symmetrical radiation pattern with respect to its axis of symmetry 6 or 6', which axes are shown in dashed lines, since otherwise undesirable transverse polarization would occur. Individual antennas which meet this requirement also meet the requirement that the voltages $\overline{U}_{vertical}$ and $\overline{U}_{horizontal}$, respectively, be the same in both individual antennas.

A particularly favorable embodiment will now be described in which the above restriction regarding radiation pattern symmetry is eliminated. If, in the arrangement of FIG. 1, instead of two identical antennas, two individual antennas 1 and 1' are used which, with respect to the reflection plane 2, have radiation patterns which are a mirror image of one another, these individual antennas need not each have a symmetrical radiation pattern. Electromagnetic waves radiated from such an antenna in a direction perpendicular to the plane of the drawing are polarized either purely vertically or purely horizontally, depending on whether the individual antennas are fed via terminal 4, i.e. in the same phase, or via terminal 5, i.e. in phase opposition, independently of the polarization of the individual antennas and thus independently of whether or not the individual antennas have radiation patterns which are symmetrical with respect to the axis of symmetry 6 or 6', respectively.

Conversely, when the antenna is used as a receiving antenna, for example as a direction finding or ranging antenna, the vertical component and the horizontal component of a signal with any desired polarization which is emitted by a transmitter disposed in the plane of reflection 2 can be received separately at the same time. In such an antenna the above condition that the voltages $\overline{U}_{vertical}$ or $\overline{U}_{horiztonal}$, respectively, be identical in both individual antennas is also met.

The present invention can be embodied in arrangements other than those having but two individual antennas. Thus, antenna arrays according to the invention may be composed of any desired number of individual antennas, it generally being the custom to use pairs of identical individual antennas which are arranged in mirror symmetry to one another or pairs of individual antennas which are a mirror image of one another and which are arranged in mirror symmetry to one another. The individual pairs may be arranged in space next to, above, or behind one another and individual antennas which belong to different pairs may even be of different types. It is important, however, that the planes of reflection of all pairs be oriented parallel to one another.

In particular, individual antennas may be provided which are individually mirror symmetrical with respect to a plane of reflection. Such individual antennas need not be arranged in mirror symmetrical pairs due to their own inherent symmetry.

According to a further advantageous embodiment of the invention there can be provided arrangements of individual antennas which are not mirror symmetrical per se and in which the mirror symmetry is produced only by giving respectively different weighting to the input or output voltages of the individual antennas when they are combined.

Figure 2:
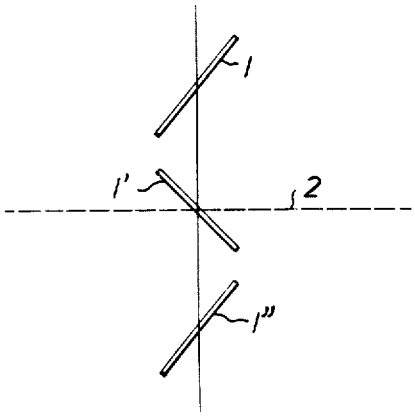
FIG. 2 is a simplified pictorial view of another embodiment of an antenna system according to the invention.

An example for such an arrangement is shown in FIG. 2 and is composed of three individual antennas 1, 1' and 1'', antennas 1 and 1'' being identical and antenna 1' constituting a mirror image of each of antennas 1 and 1 ". By additive combination of the output voltages of these three individual antennas a radiation pattern is obtained which is symmetrical with respect to the plane 2, shown in dashed lines, if the output voltage of the individual antenna 1' is weighted with a factor 1 and the output voltage of antennas 1 and 1" are each weighted with a factor 0.5. It is insignificant in this connection whether such weighting is effected by means of passive or active members.

Other antenna arrangements than that shown in FIG. 2 are also possible within the scope of the present invention, for example those with individual antennas of different types as well as any desired position and orientation.

The present invention can be expanded in that mirror symmetry is provided not only with respect to planes which are parallel to a single preferred plane, but also with respect to a plurality of preferred planes of any desired orientation.

The individual antennas in all embodiments are preferably antennas having one or a plurality of reflectors, particularly logarithimic-periodic antennas with additional reflectors, since such antennas have relatively small dimensions in spite of having a particularly wide bandwidth. Such antennas are disclosed, for example, in our copending application filed on Nov. 17th, 1975, entitled BROADBAND ANTENNA HAVING SMALL DIMENSIONS.

Figure 8:
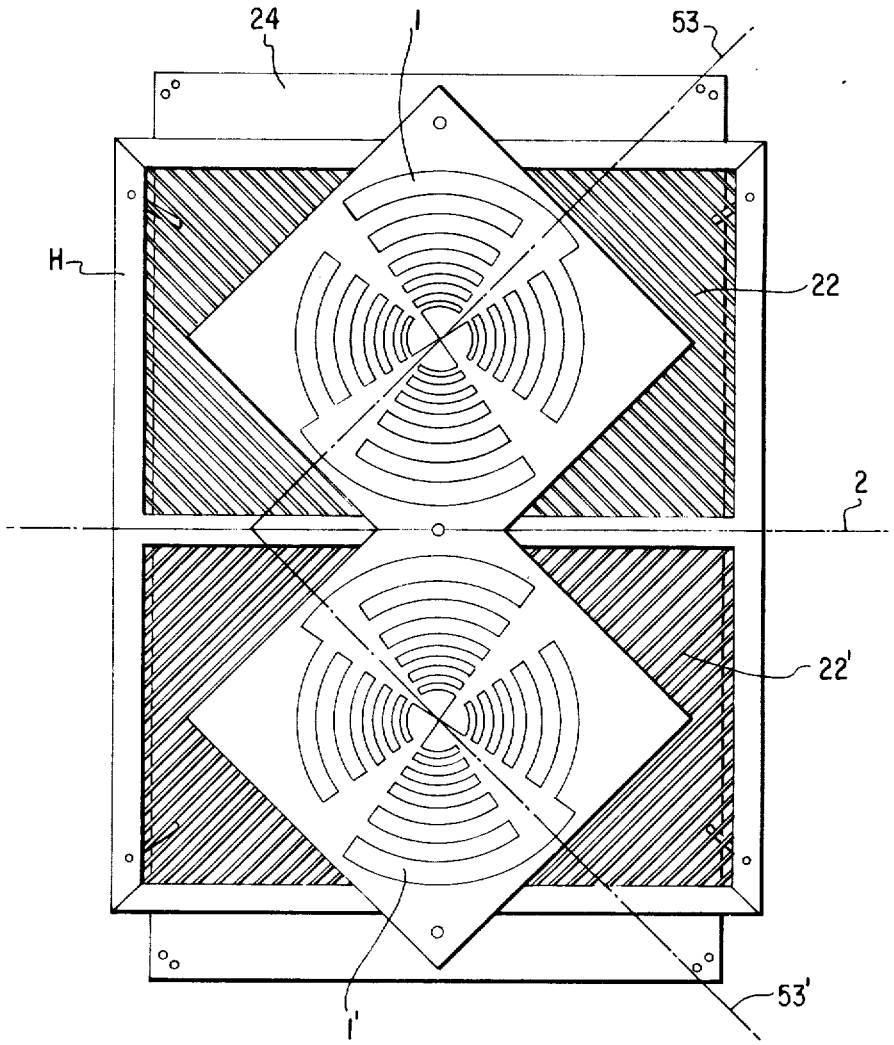
FIG. 8 is a front elevational view of a working embodiment of an antenna system according to the invention.

One example of such an embodiment is shown in FIG. 8 and is composed of two logarithmic-periodic antennas 1 and 1' each having an asymmetrical radiation pattern. Each of these individual antennas has an asymmetrical radiation pattern with respect to its respective axis 53 or 53'. The antennas 1 and 1' are constructed to be mirror images of one another and are arranged in mirror symmetry to one another with respect to the plane 2. Axes 53 and 53' are perpendicular to one another. Antennas 1 and 1' are mounted in front of a pair of reflectors 22 and 22' each composed of a plurality of parallel wires held in a frame H. Both reflectors are polarization selective and their polarization directions are perpendicular to one another since the wires of reflector 22 are perpendicular to those of reflector 22'. Behind reflectors 22 and 22', i.e. further away from antennas 1 and 1', is a further reflector 24 composed of a metal plate constituting a form of non-polarization selective reflector. In the following sections it will be described what is understood by a symmetrical and an asymmetrical radiation pattern.

FIG. 3 shows a capacitively (top) loaded symmetrical dipole antenna 31, which consists of wires, which are placed in the plane of the drawing. The output voltage of this antenna has the same magnitude independent of whether the plane of polarization of a linear polarized electromagnetic wave which impinges in a direction perpendicular to the plane of the drawing has the orientation 33 or 34, which differ from the axis 32 of the dipole antenna by an angle of $\alpha$ and $-\alpha$ respectively, because the antenna has a symmetrical structure. The radiation pattern, which represents the magnitude of the output voltage of the antenna dependent on the orientation of the plane of polarization of a linear polarized electromagnetic wave, is therefore symmetrical with respect to axis 32.

FIG. 4 shows a capacitively (top) loaded asymmetrical dipole antenna 41, which consists of wires, which are placed in the plane of the drawing. The magnitude of the output voltage of this antenna is dependent of whether the plane of polarization of a linear polarized electromagnetic wave which impinges in a direction perpendicular to the plane of the drawing has the orientation 43 or 44, which differ from the axis 42 of the dipole antenna by an angle of $\alpha$ and $-\alpha$ respectively, because the antenna has an asymmetrical structure. The radiation pattern which represents the magnitude of the output voltage of the antenna dependent on the orientation of the plane of polarization of a linear polarized electromagnetic wave, is therefore asymmetrical with respect to axis 42.

FIG. 5 shows a well known planar two-section logarithmic periodic antenna, which has an symmetrical radiation pattern as described before. This kind of antenna is already described in out copending application filed on Nov. 17th, 1975, entitled BROADBAND ANTENNA HAVING SMALL DIMENSIONS.

FIG. 6 shows an embodiment of an antenna system according to the invention, which consists of two identical antennas 61 and 63, which have the form shown in FIG. 5 and an antenna 62, which has a form that is mirror symmetrical with respect to the form of the antennas 61 and 63. The antennas are arranged as described in connection with FIG. 2. Additionally the arrangement in FIG. 6 contains a dividing or combining coupler respectively a hybrid 68 with voltage adjusting members 65 to 67 both for phase and amplitude adjustment. The antenna arrangement of FIG. 6 has a symmetrical radiation pattern for waves radiated in a plane perpendicular to the drawing plane.

FIG. 7 shows an embodiment of an antenna system according to the invention, which consists of two mirror symmetrical antennas 71 and 72 shown in FIG. 5, only the axes of these antennas being shown, the antenna being arranged as shown in FIG. 1, with a combining network 73 (hybrid or quadrature hybrid) with two outputs 74 and 75.

By additive or subtractive combination of the output voltages of the two individual antennas 71 and 72 in the combining network 73 there is obtained at the terminal 74 or 75 of the combining network a voltage which is proportional to the vertical or horizontal component of the electrical field strength of an electromagnetic wave which impinges in a direction perpendicular to the plane of the drawing.

In the case of a quadrature hybrid as a combining network 73 the electromagnetic wave is right or left hand elliptically polarized.

In FIG. 7 there is additionally provided a phase shifter 76 which allows the choice of any desired polarization (linear or ellipitcal polarization).

In the receiving case there exists a number of possible embodiments in which the output voltages of the individual antennas are amplified before feeding to the combining network. In this case the voltages are called "derived voltages" as written in claim 1.

It will be understood that the above description of the prevent invention is susceptible to various modifications, changes and adaptations, and the same are intended to be comprehended within the meaning and range of equivalents of the appended claims.

What is claimed is:

1. An antenna arrangement comprising at least two individual antennas each having a pair of signal applying terminals and each presenting a frequency dependent polarization characteristics, and circuit means connected to said terminals of said antennas for establishing a selected relation between the voltages across all said terminals or between voltages derived from these voltages, wherein two of said individual antennas each have an asymmetrical radiation pattern and, for giving said arrangement a desired radiation polarization characteristic, one of said two individual antennas is constructed to constitute the mirror image of the other, and said two individual antennas are positioned in mirror symmetry to one another with respect to a selected plane so that their radiation patterns are in mirror symmetry to one another with respect to said selected plane.

2. An arrangement as defined in claim 1 wherein each of said antennas includes reflector.

3. An arrangement as defined in claim 1 wherein all of said antennas are of the same type.

4. An arrangement as defined in claim 1 wherein each said antenna is a broadband antenna.

5. An arrangement as defined in claim 4 wherein each said antenna is a logarithmic-periodic antenna.

6. An arrangement as defined in claim 4 wherein each said antenna has at least one reflector.

7. An arrangement as defined in claim 1 wherein said antennas are arranged in at least one pair, with each antenna of said pair being inclined at an angle of 45° to said plane so that the two antennas of a pair are perpendicular to one another.

8. An arrangement as defined in claim 1 wherein each said antenna has a design operating frequency range associated with a given polarization characteristic and has the same polarization with respect to frequencies below such operating range.

9. An arrangement as defined in claim 1 wherein said circuit means comprises an energy dividing or combining coupler having external terminals and arranged to cause the voltage at each external terminal to represent a selected algebraic combination of the voltages across said signal applying terminals of said antennas.

10. An arrangement as defined in claim 9 wherein said circuit means comprise voltage adjusting members connected for imparting respectively different weightings to the signal across said pairs of signal applying terminals of respectively different antennas.

11. An arrangement as defined in claim 10 wherein such different weightings are at least partly with respect to signal amplitudes.

12. An arrangement as defined in claim 10 wherein such different weightings are at least partly with respect to signal phases.

13. An arrangement as defined in claim 10 wherein such different weightings are at least partly with respect to signal frequencies.

14. An arrangement as defined in claim 1 wherein said circuit means comprise members connected for establishing a predetermined relation between the voltages across said signal applying terminals of said antennas for imparting a selected radiation pattern polarization to said arrangement.

15. An arrangement as defined in claim 14 wherein said members impart an elliptical polarization pattern to said arrangement.

16. An arrangement as defined in claim 1 constituting a transmitting antenna arrangement.

17. An arrangement as defined in claim 1 constituting a receiving, direction finding or ranging antenna arrangement.

18. An arrangement as defined in claim 1 constituting an antenna arrangement which operates alternatingly as a transmitting and receiving, direction finding or ranging arrangement.

19. An arrangement as defined in claim 1 further comprising a third individual antenna having a pair of signal applying terminals connected to said circuit means and presenting a frequency dependent polarization characteristic, said third antenna being constructed to constitute the mirror image of one of said two individual antennas and being positioned in mirror symmetry to said one of said two individual antennas with respect to a second selected plane.

* * * * *